US009140510B1

(12) United States Patent
Muska

(10) Patent No.: US 9,140,510 B1
(45) Date of Patent: Sep. 22, 2015

(54) ROTARY DISCONNECTOR

(71) Applicant: Smith & Wesson Corp., Springfield, MA (US)

(72) Inventor: Simon Michael Muska, Enfield, CT (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/311,512

(22) Filed: Jun. 23, 2014

(51) Int. Cl.
*F41A 19/42* (2006.01)
*F41A 19/12* (2006.01)

(52) U.S. Cl.
CPC ..... *F41A 19/42* (2013.01); *F41A 19/12* (2013.01)

(58) Field of Classification Search
CPC ..... F41A 19/12; F41A 19/31; F41A 19/24; F41A 19/10; F41A 19/16; F41A 19/14; F41A 19/45
USPC ..... 89/145, 146, 144; 42/69.01, 69.02, 42/69.03
See application file for complete search history.

(56) References Cited

U.S. PATENT DOCUMENTS

| | | | | |
|---|---|---|---|---|
| 2,846,925 | A * | 8/1958 | Norman | 89/145 |
| 3,728,810 | A | 4/1973 | Rohr | |
| 3,857,322 | A | 12/1974 | Lichtman | |
| 3,949,508 | A | 4/1976 | Elkas | |
| 3,972,142 | A | 8/1976 | Kawamura | |
| 4,017,996 | A | 4/1977 | Liedke | |
| 4,057,003 | A | 11/1977 | Atchisson | |
| 4,409,882 | A | 10/1983 | Blackshaw et al. | |
| 4,553,469 | A | 11/1985 | Atchisson | |
| 4,706,401 | A * | 11/1987 | Nielsen | 42/69.03 |
| 4,899,477 | A | 2/1990 | Aigner | |
| 4,932,309 | A | 6/1990 | Barrett | |
| 5,320,023 | A * | 6/1994 | Erdem | 89/195 |
| 5,373,775 | A | 12/1994 | Findlay, Sr. et al. | |
| 5,386,659 | A * | 2/1995 | Vaid et al. | 42/69.02 |
| 5,697,178 | A * | 12/1997 | Haskell | 42/70.04 |
| 5,939,657 | A | 8/1999 | Morgado | |
| 6,412,206 | B1 * | 7/2002 | Strayer | 42/69.03 |
| 6,412,208 | B1 | 7/2002 | Mikuta et al. | |
| 6,634,129 | B1 | 10/2003 | Freeman, Jr. | |
| 7,096,618 | B2 | 8/2006 | McGarry | |
| 7,194,833 | B1 * | 3/2007 | Curry | 42/14 |
| 7,810,268 | B1 * | 10/2010 | McGarry | 42/69.01 |
| 8,601,932 | B1 * | 12/2013 | Karfiol et al. | 89/144 |
| 2012/0096752 | A1 * | 4/2012 | Lee | 42/69.01 |

* cited by examiner

*Primary Examiner* — Troy Chambers
*Assistant Examiner* — Bridget Cochran
(74) *Attorney, Agent, or Firm* — Ballard Spahr LLP; John A. Chionchio, Esq.

(57) ABSTRACT

A pistol has a disconnector for disconnecting a trigger bar from a sear to allow the sear to reset and engage and hold a hammer in a cocked position. Motion of a slide causes rotation of the disconnector through interaction between a cam surface on the slide and a cam follower on the disconnector. A contact surface on the disconnector engages the trigger bar upon rotation of the disconnector and moves the trigger bar out of engagement with the sear. A biasing spring resets the sear into engagement with the hammer which is rotated into the cocked position by motion of the slide.

20 Claims, 8 Drawing Sheets

FIG. 2
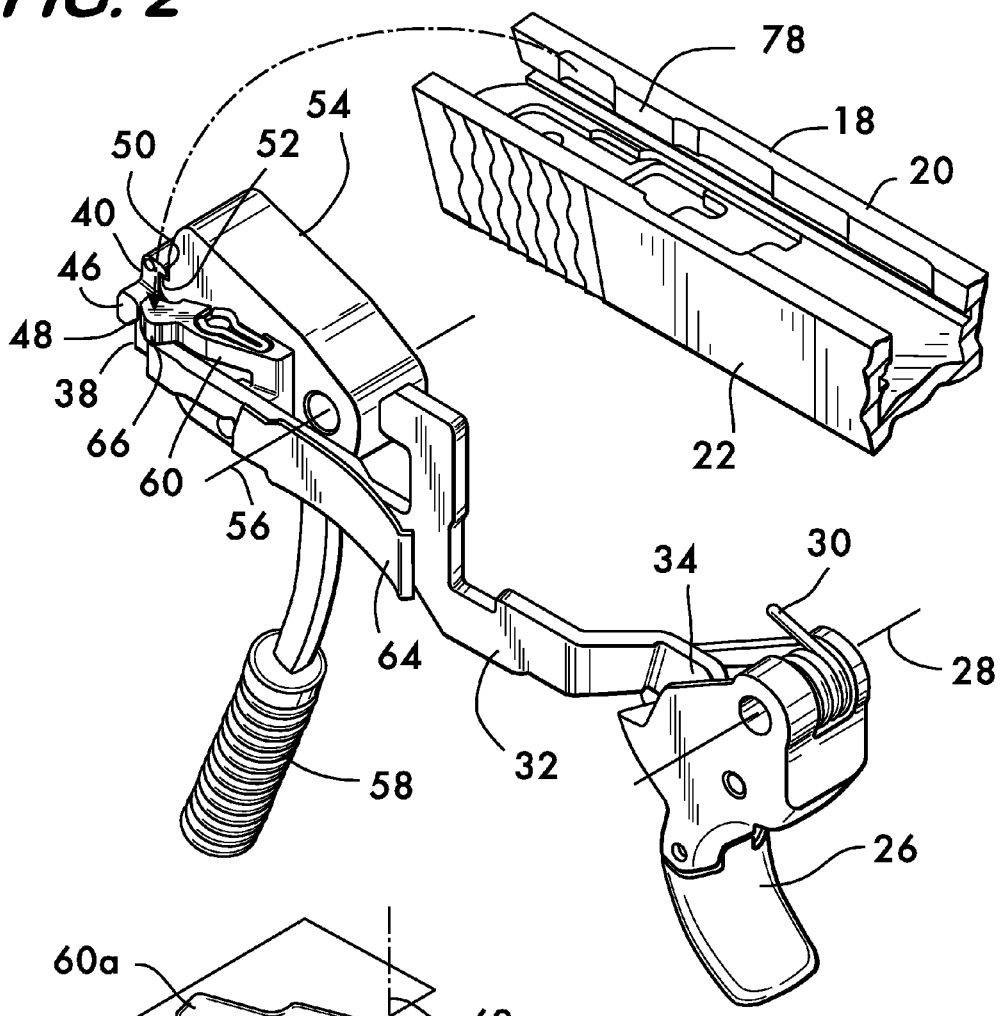
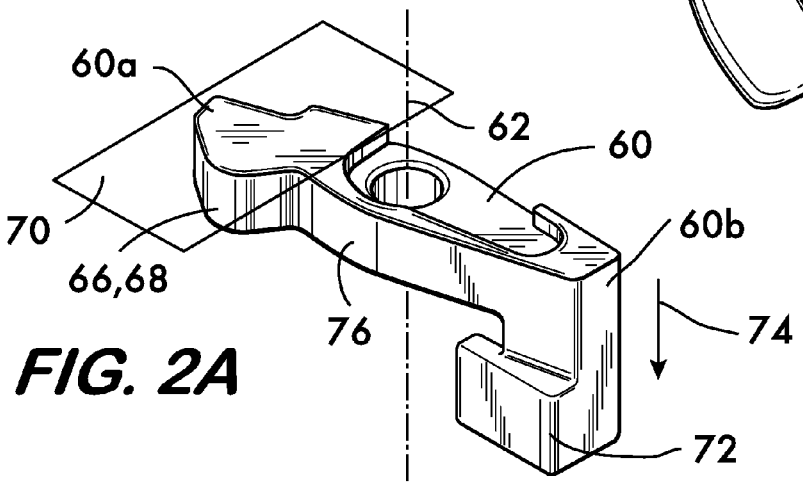
FIG. 2A

ROTARY DISCONNECTOR

FIELD OF THE INVENTION

This invention relates to a disconnector used in a firearm for disconnecting a trigger bar from a sear to permit reset of the sear during semiautomatic operation of the firearm.

BACKGROUND

Trigger mechanisms in modern semiautomatic pistols may use a trigger bar to transmit the motion of the trigger to the sear. Motion of the sear releases the hammer to discharge the pistol. To complete the firing sequence so that the next round may be fired in single action it is necessary to disengage the trigger bar from the sear so that the sear can be reset and capture the hammer in the cocked position.

Disconnectors according to the prior art often result in an unwanted increase in the size of the pistol because the disconnector must operate in an area of the pistol outside of the operating space allocated to the sear and hammer. The increased need for space to house the disconnector makes the pistol bulky and renders it less suitable for certain uses, such as concealed carry. There is clearly an advantage to a disconnector that does not significantly increase the bulkiness or size of a pistol.

SUMMARY

The invention concerns a disconnector for a pistol. The pistol has a frame, a slide movably mounted on the frame, a cam surface positioned on the slide, a sear rotatably mounted on the frame, and a trigger bar movably mounted on the frame. A portion of said trigger bar is engageable with the sear. In an example embodiment, the disconnector comprises a body mounted on the frame for rotation about an axis. The body has a cam follower engageable with the cam surface and a contact surface engageable with the trigger bar. In operation, motion of the slide relatively to the frame causes the cam surface to engage the cam follower, thereby rotating the body about the axis. The contact surface thereby engages the trigger bar and moves the portion thereof out of engagement with the sear.

In a particular example embodiment, the cam follower is positioned on a first side of the axis and the contact surface is positioned on a second side of the axis opposite to the first side. In one example, the cam follower comprises a lobe projecting from the body in a plane substantially perpendicular to the axis. By way of example, the cam follower may define a first plane and the contact surface may be offset therefrom in a direction substantially parallel to the axis.

In one example embodiment, the cam follower is positioned at a first end of the body and the contact surface is positioned at a second end of the body opposite to the first end. By way of further example, the body has first and second sides arranged opposite to one another. In a particular example, both the cam follower and the contact surface are positioned on a same one of the sides. By way of further example, the axis is oriented perpendicularly to a line of motion of the slide.

The invention also encompasses a pistol using a rotary disconnector. In one example embodiment, the pistol comprises a frame. A slide is movably mounted on the frame. A cam surface is positioned on the slide. A sear is rotatably mounted on the frame. A trigger bar is movably mounted on the frame. A portion of the trigger bar is engageable with the sear. A disconnector body is mounted on the frame for rotation about an axis. The disconnector body has a cam follower engageable with the cam surface and a contact surface engageable with the trigger bar. In operation, motion of the slide relatively to the frame causes the cam surface to engage the cam follower, thereby rotating the disconnector body about the axis. The contact surface thereby engages the trigger bar and moves the portion thereof out of engagement with the sear.

In a particular example embodiment, the cam follower is positioned on a first side of the axis and the contact surface is positioned on a second side of the axis opposite to the first side. By way of further example, the cam follower may comprise a lobe projecting from the disconnector body in a plane perpendicular to the axis. Additionally by way of example, the cam follower may define a first plane and the contact surface may be offset therefrom in a direction substantially parallel to the axis.

In another example embodiment, the cam follower is positioned at a first end of the disconnector body and the contact surface is positioned at a second end of the disconnector body opposite to the first end.

In another example embodiment, the disconnector body has first and second sides arranged opposite to one another. In a particular example, both the cam follower and the contact surface are positioned on a same one of the sides.

In an example pistol embodiment, the frame comprises first and second rails positioned on opposite sides thereof. The slide comprises first and second sidewalls oppositely disposed from one another. The first and second sidewalls respectively engage the first and second rails to permit sliding motion of the slide relatively to the frame. In this example, the cam surface is positioned on the first sidewall of the slide.

In a particular example, the cam surface is angularly oriented with respect to the first rail. By way of further example, the axis is oriented perpendicularly to a line of motion of the slide relatively to the frame.

In an example embodiment, a spring acts on the trigger bar for biasing the trigger bar away from the frame. In a particular example, the spring comprises a leaf spring mounted on the trigger bar. By way of example, the portion of the trigger bar engageable with the sear comprises an end of the trigger bar.

The invention also contemplates a method of resetting a sear into a ready position during operation of a pistol. An example of the method comprises:

- moving a slide;
- engaging a cam surface on the slide with a cam follower on a rotatable body and thereby rotating the rotatable body;
- engaging a contact surface on the rotatable body with a trigger bar engaged with the sear and thereby moving the trigger bar relatively to the sear and out of engagement therewith;
- moving the sear into the ready position upon disengagement with the trigger bar.

BRIEF DESCRIPTION OF THE DRAWINGS

FIG. 2 is an isometric view showing a portion of the slide, hammer, sear, trigger bar, trigger and rotary disconnector in relation to one another;

FIG. 2A is an isometric view of an example embodiment of a rotary disconnector according to the invention;

DETAILED DESCRIPTION

Figure 1:
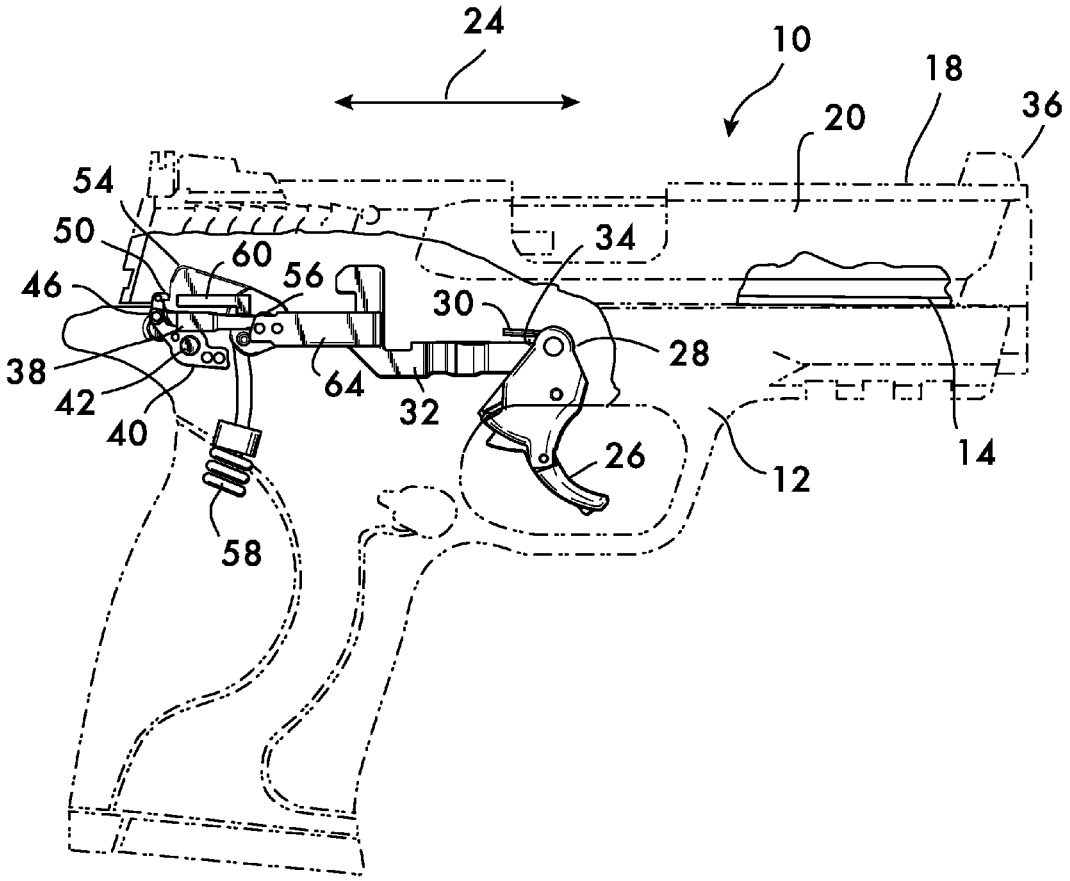
FIG. 1 is a side view of a semiautomatic pistol using an example embodiment of a rotary disconnector according to the invention.

FIG. 1 shows a side view of an example semiautomatic pistol 10 according to the invention. Pistol 10 comprises a frame 12 having first and second rails 14 and 16 (14 being shown) positioned on opposite sides of the frame. A slide 18 is movably mounted on the rails 14 and 16 of frame 12. Slide 18 has first and second sidewalls 20 and 22 oppositely disposed from one another (sidewall 20 being shown), each sidewall engaging a respective rail 14 and 16 of frame 12. Slide 18 is capable of reciprocal motion relatively to frame 12 along a line of motion defined by the rails 14 and 16 illustrated by arrow 24.

As shown in FIGS. 1 and 2, Pistol 10 further comprises a trigger 26 rotatably mounted on frame 12 for pivoting motion about a trigger pivot axis 28. A trigger spring 30 acting between the trigger 26 and the frame 12 (or a sub-component positioned within the frame) biases the trigger in the counterclockwise direction when viewed from the right side of pistol 10 as shown. (All references to "clockwise" and "counterclockwise" herein describe a rotation with reference to the drawings.) A trigger bar 32 has a first end 34 attached to the trigger 26 at a position offset from the trigger pivot axis 28 such that clockwise rotation of the trigger 26 (i.e., trigger being pulled) will result in a displacement of the trigger bar 32 away from the muzzle end 36 of the pistol 10. The trigger bar 32 is pivotably connected to the trigger 26 which permits translation of the trigger bar substantially parallel to line of motion 24 without significant rotation relatively to the frame 12.

Figure 3:
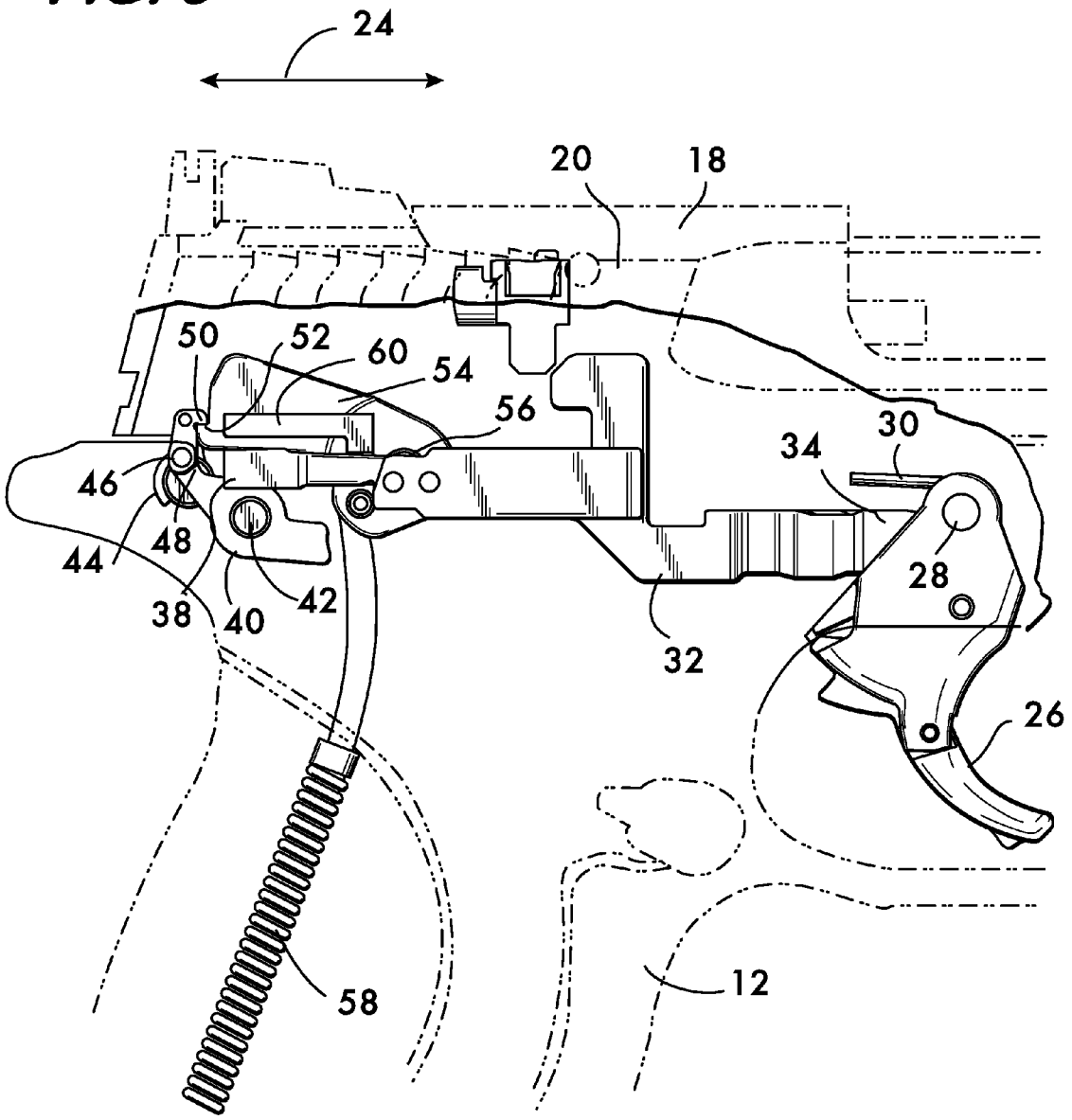
FIGS. 3 and 4 show partial sectional side views of the pistol shown in FIG. 1 in operation.
Figure 4:
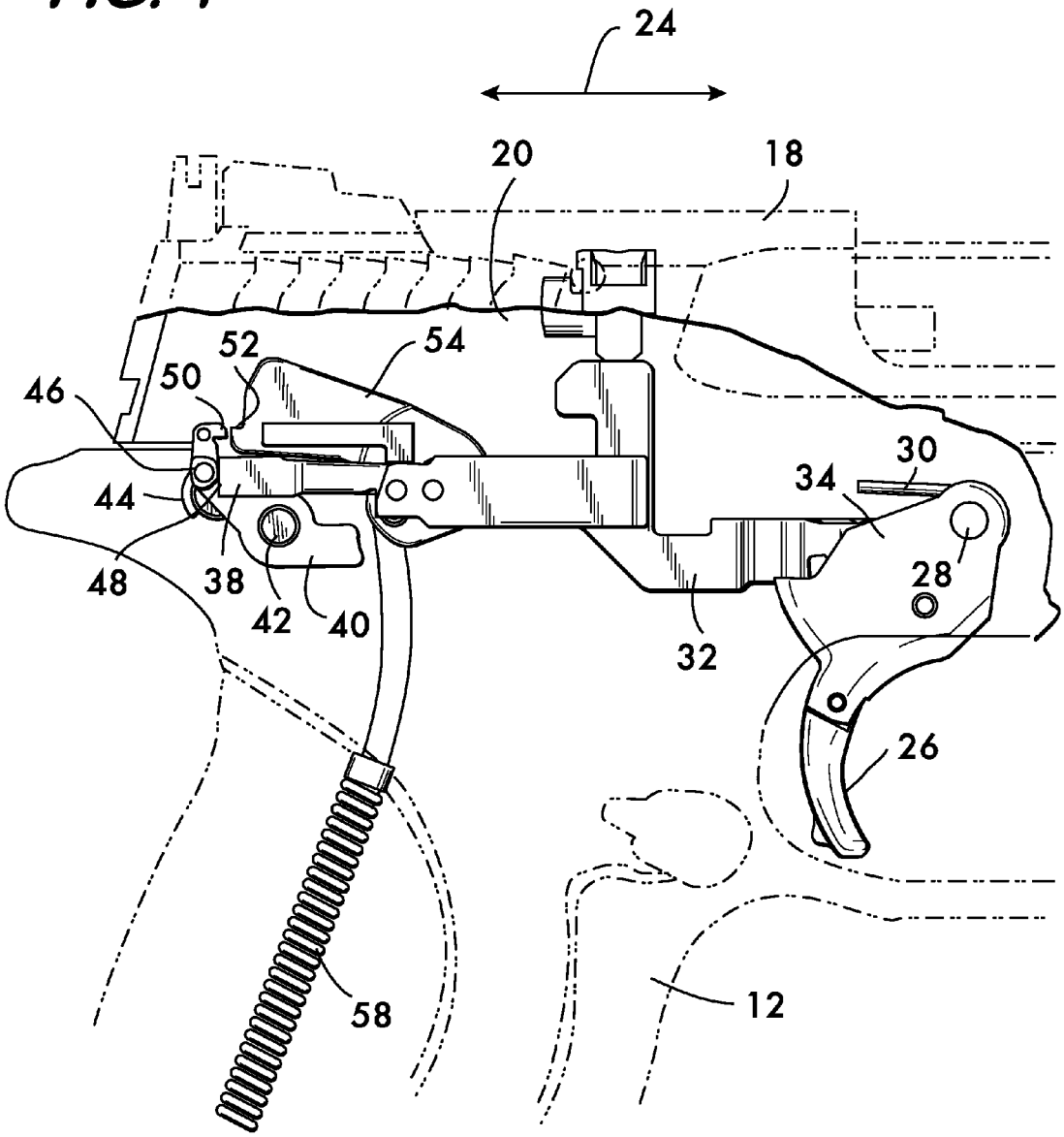

As shown in FIGS. 2 and 3, a portion 38 of trigger bar 32 is engageable with a sear 40. In this example, the portion 38 engageable with sear 40 comprises a second end of the trigger bar, oppositely disposed from the first end 34. Sear 40 is rotatably mounted on frame 12 for pivoting motion about a sear pivot axis 42. A sear spring 44 acting between the frame 12 and the sear 40 biases the sear in the clockwise direction. Sear 40 has a post 46 that projects perpendicularly to the line of motion 24 of the trigger bar 32 and provides a surface 48 permitting engagement between the sear 40 and the second end 38 of trigger bar 32. Sear 40 also comprises a projecting catch 50 that engages a notch 52 in a hammer 54. Hammer 54 is rotatably mounted on frame 12 for pivoting motion about a hammer pivot axis 56. A hammer spring 58 acts between the hammer 54 and the frame 12 to bias the hammer in the clockwise direction. Sear catch 50 cooperates with hammer notch 52 to hold the hammer 54 in the cocked position against the force of its biasing spring 58 as shown in FIGS. 2 and 3. As shown in FIG. 4, rotation of the sear 40 causes the sear catch 50 to fall off of the hammer notch 52 and thereby permit the hammer to rotate clockwise under the biasing force of the hammer spring 58 to discharge the pistol.

Figure 5:
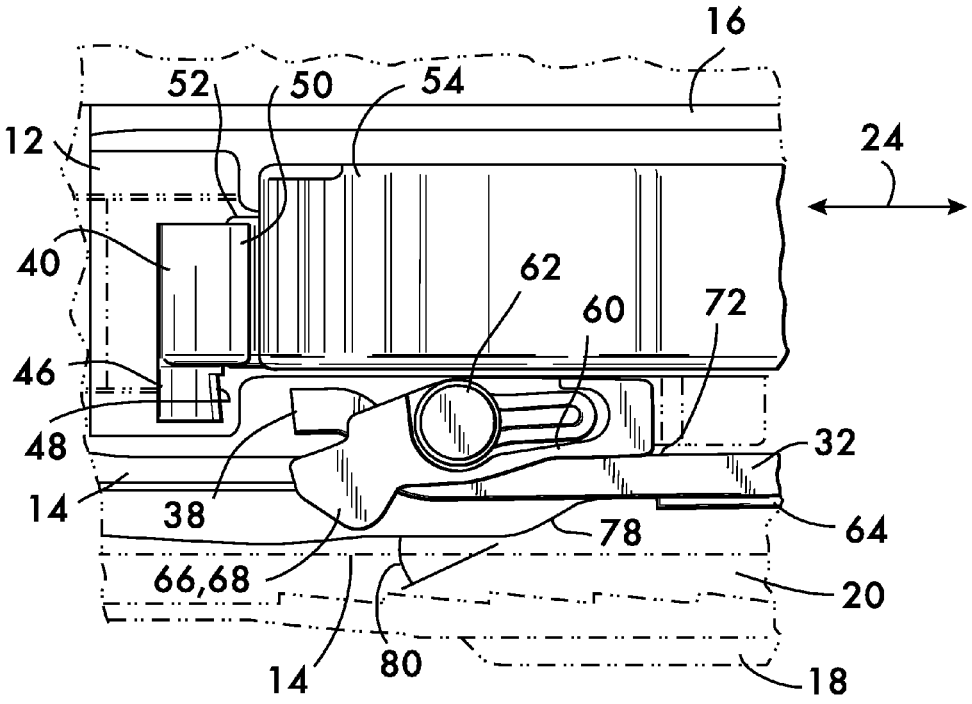
FIGS. 5-8 show partial sectional top views of the pistol shown in FIG. 1 in operation.

As shown in FIGS. 2, 2A and 3, a disconnector body 60 is rotatably mounted on frame 12. In this example embodiment, disconnector body 60 is rotatable about an axis 62 oriented perpendicularly to the line of motion 24. As shown in FIGS. 2, 2A and 5, disconnector body 60 further comprises a cam follower 66 in the form of a lobe 68. Lobe 68 projects from the disconnector body 60 in a plane 70 oriented perpendicularly to the axis 62. In this example embodiment, the cam follower 66 (lobe 68) is positioned on one side of axis 62, and a contact surface 72 is positioned on disconnector body 60 on the opposite side of axis 62. Further in this example embodiment, contact surface 72 is offset from the plane 70 defined by the lobe 68 (cam follower 66) in a direction 74 substantially parallel to axis 62. As shown in FIG. 2A, the cam follower 66 (lobe 68) is positioned at a first end 60*a* of disconnector body 60, and the contact surface 72 is positioned at a second end 60*b* of the disconnector body opposite to the first end. Additionally in this example, both the cam follower 66 (lobe 68) and the contact surface 72 are positioned on the same side 76 of the disconnector body 60.

FIGS. 2 and 5 also illustrate a cam surface 78 positioned on sidewall 20 of slide 18. A portion of cam surface 78 is angularly oriented with respect to the rail 14, as shown by orientation angle 80. The positions of the cam follower 66 (lobe 68) on disconnector body 60 and the cam surface 78 are arranged so that motion of slide 18 along line of motion 24 will induce clockwise rotational motion of the disconnector body 60 about its axis 62 through contact between the cam follower 66 and the cam surface 78 as explained below. Furthermore, the position of contact surface 72 and the trigger bar 32 are arranged so that, upon clockwise rotation of disconnector body 60, the trigger bar is pushed outwardly away from the sear 40 through contact between the contact surface 72 and a portion of the trigger bar 32. Additionally, the position, angle, and length of cam surface 78, the distances of the cam follower 66 and the contact surface 72 from the axis 62 of disconnector body 60 are all coordinated to facilitate proper functioning of the pistol 10 during operation as described below.

Operation of the rotary disconnector is described below with reference to FIGS. 5-8. As shown in FIG. 5 (see also FIGS. 1 and 3), the pistol 10 is ready to be fired in single action. A round is chambered, the breech is closed (not shown) and the hammer 54 is cocked and held in the cocked position by the sear 40. Rotary disconnector body 60 is biased in a counterclockwise direction about its axis 62 by a force applied to the contact surface 72 by the trigger bar 32. A leaf spring 64 mounted on the trigger bar 32 (see also FIG. 2) acting against the frame 12 biases the trigger bar away from the sidewall 20 of slide 18 and toward the hammer 54, aligning the end 38 of the trigger bar with post 46 of sear 40. Contact between the trigger bar 32 and contact surface 72 of disconnector body 60 biases the body in the counterclockwise direction against a positive stop (not shown) which limits counterclockwise rotation. Consequently, the cam follower 66 (lobe 68) is biased toward cam surface 78 on sidewall 20 of slide 18. Trigger 26 (see FIGS. 1 and 2) is biased in a counterclockwise direction by trigger spring 30 so that the end 38 of the trigger bar 32 does not engage the sear post 46.

Figure 6:
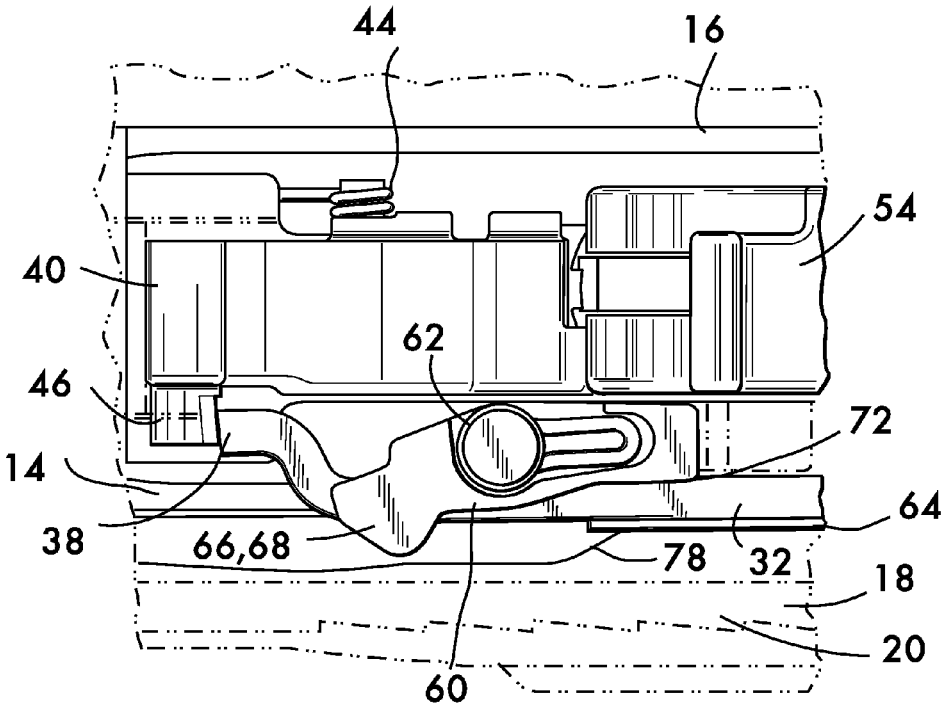

As shown in FIGS. 2, 4 and 6, trigger 26 is pulled (rotated clockwise about axis 28) causing the end 38 of the trigger bar 32 to engage sear post 46 and rotate sear 40 counterclockwise about axis 42 against its biasing spring 44. The sear catch 50 falls off of the hammer notch 52 allowing the hammer 54 to rotate clockwise about axis 56 under the force of its spring 58 and strike a firing pin (not shown) to discharge the chambered round.

Figure 7:
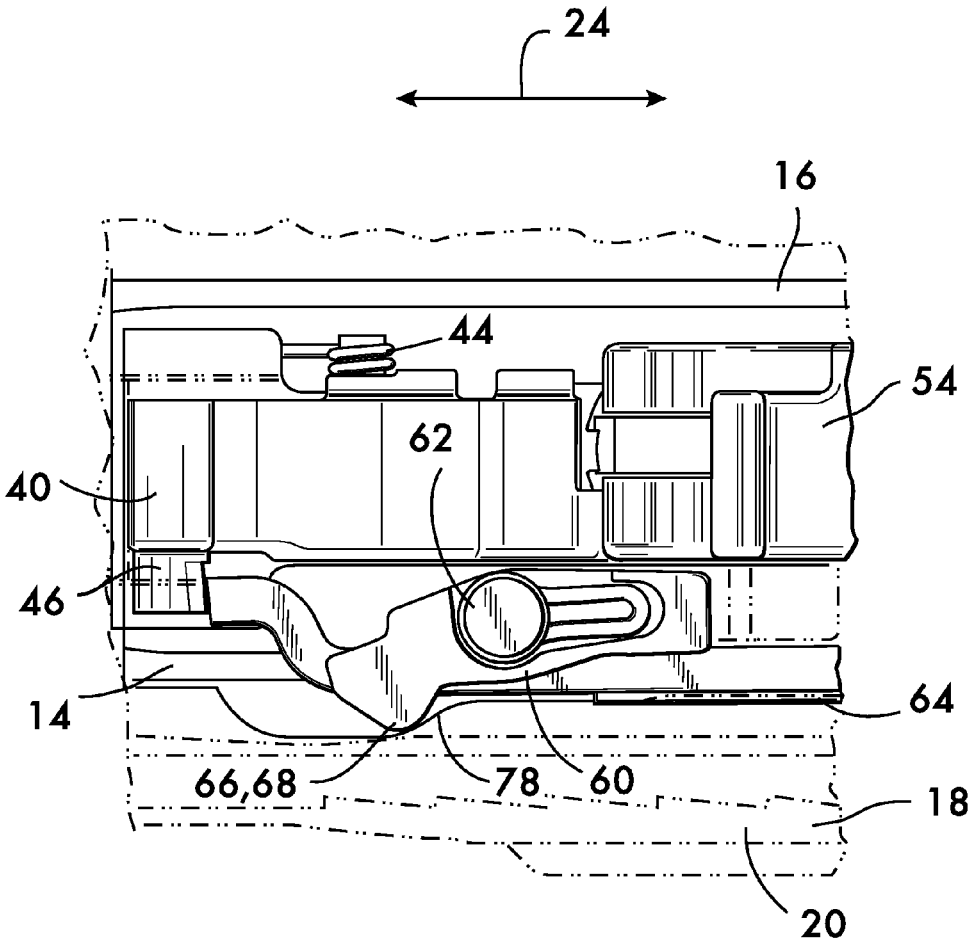

As shown in FIG. 7, energy from the fired round causes the slide 18 to move along line of motion 24 toward the sear 40. This motion of slide 18 also brings the cam surface 78 into contact with the cam follower 66, lobe 68. Interaction between the cam surface 78 and cam follower 66 causes the disconnector body 60 to rotate about axis 62 in a clockwise direction.

Figure 8:
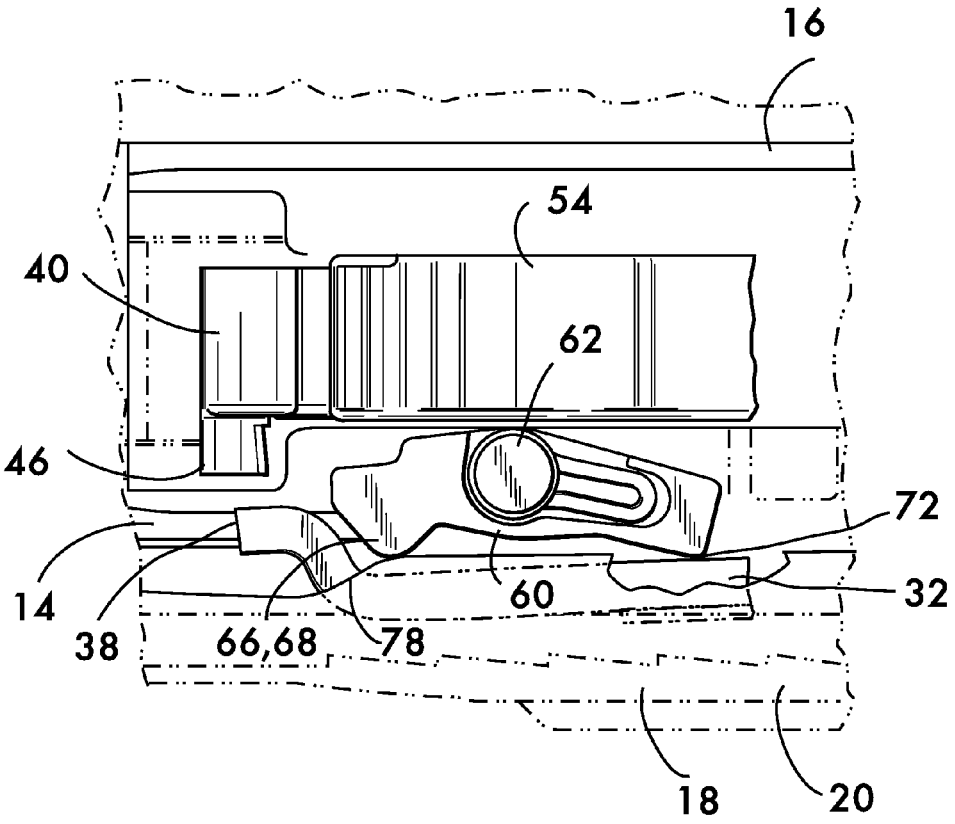

As shown in FIG. 8, upon clockwise rotation of the disconnector body 60 about axis 62, the contact surface 72 is brought into engagement with the trigger bar 32 and the trigger bar is thereby pushed outwardly and away from the sear 40. Outward motion of the trigger bar 32 out of alignment with the sear post 46 is permitted by the trigger bar's inherent flexibility due, for example, to permissible clearance between components. The end 38 of the trigger bar 32 thereby disengages from the sear post 46. The sear 40 is thus free to rotate clockwise about axis 42 (see FIG. 3) under the force of its biasing spring 44 so that the sear catch 50 can again engage the hammer notch 52 of hammer 54, the hammer having been rotated counterclockwise about axis 56 against its biasing spring 58 and into the cocked position by interaction with the slide 18 as it moved towards the sear and hammer.

Once it reaches the end of its travel after discharge, the slide 18 is moved back toward the muzzle end 36 of pistol 10 by a slide return spring (not shown). As the slide 18 moves "into battery" (i.e., next round chambered, breech closed) the cam surface 78 on the slide 18 disengages from the cam follower 66 of the disconnector body 60 (compare FIGS. 7 and 8), thereby allowing the disconnector body to rotate counterclockwise about axis 62. As noted above, the disconnector body 60 is indirectly biased counterclockwise about axis 62 by leaf spring 64 mounted on the trigger bar 32. Biased by its leaf spring 64, the trigger bar acts against the contact surface 72 to rotate the disconnector body counterclockwise as the cam follower 66 moves off of the cam surface 78. Leaf spring 64 also ensures that the trigger bar 32 returns to its position of alignment with the sear post 46 so that the end 38 of the trigger bar 32 will engage the sear post and rotate the sear 40 to again discharge pistol 10 upon the next trigger pull. Because the trigger 26 is biased counterclockwise by spring 30 (see FIGS. 1 and 2), release of pressure on the trigger 32 will permit the trigger bar 32 to move back into the position shown in FIGS. 1, 3 and 5, with the end 38 of the trigger bar out of engagement (but aligned) with the sear post 46, ready to discharge the next round, which was chambered by the slide as it moved back into battery under the force of its slide return spring.

Pistols having rotary disconnectors according to the invention are expected to combine smooth and reliable operation in a small volume, useful in many applications, such as concealed carry, where prior art pistols are at a disadvantage due to their larger bulk.

What is claimed is:

1. A disconnector for a pistol, said pistol having a frame, a slide movably mounted on said frame, a cam surface being positioned on said slide, a sear rotatably mounted on said frame, and a trigger bar movably mounted on said frame, a portion of said trigger bar being engageable with said sear, said disconnector comprising:

a body mounted on said frame for rotation about an axis, said body having a cam follower engageable with said cam surface and a contact surface engageable with said trigger bar; wherein motion of said slide relatively to said frame causes said cam surface to engage said cam follower, thereby rotating said body about said axis, said contact surface thereby engaging said trigger bar and moving said portion thereof out of engagement with said sear.

2. The disconnector according to claim 1, wherein said cam follower is positioned on a first side of said axis and said contact surface is positioned on a second side of said axis opposite to said first side.

3. The disconnector according to claim 1, wherein said cam follower comprises a lobe projecting from said body in a plane substantially perpendicular to said axis.

4. The disconnector according to claim 1, wherein said cam follower defines a first plane and said contact surface is offset therefrom in a direction substantially parallel to said axis.

5. The disconnector according to claim 1, wherein said cam follower is positioned at a first end of said body and said contact surface is positioned at a second end of said body opposite to said first end.

6. The disconnector according to claim 1, wherein said body has first and second sides arranged opposite to one another, both said cam follower and said contact surface being positioned on a same one of said sides.

7. The disconnector according to claim 1, wherein said axis is oriented perpendicularly to a line of motion of said slide.

8. A pistol, said pistol comprising:

a frame;

a slide movably mounted on said frame;

a cam surface positioned on said slide;

a sear rotatably mounted on said frame;

a trigger bar movably mounted on said frame, a portion of said trigger bar being engageable with said sear;

a disconnector body mounted on said frame for rotation about an axis, said disconnector body having a cam follower engageable with said cam surface and a contact surface engageable with said trigger bar; wherein motion of said slide relatively to said frame causes said cam surface to engage said cam follower, thereby rotating said disconnector body about said axis, said contact surface thereby engaging said trigger bar and moving said portion thereof out of engagement with said sear.

9. The pistol according to claim 8, wherein said cam follower is positioned on a first side of said axis and said contact surface is positioned on a second side of said axis opposite to said first side.

10. The pistol according to claim 8, wherein said cam follower comprises a lobe projecting from said disconnector body in a plane perpendicular to said axis.

11. The pistol according to claim 8, wherein said cam follower defines a first plane and said contact surface is offset therefrom in a direction substantially parallel to said axis.

12. The pistol according to claim 8, wherein said cam follower is positioned at a first end of said disconnector body and said contact surface is positioned at a second end of said disconnector body opposite to said first end.

13. The pistol according to claim 8, wherein said disconnector body has first and second sides arranged opposite to one another, both said cam follower and said contact surface being positioned on a same one of said sides.

14. The pistol according to claim 8, wherein:

said frame comprises first and second rails positioned on opposite sides thereof;

said slide comprises first and second sidewalls oppositely disposed from one another, said first and second sidewalls respectively engaging said first and second rails to permit sliding motion of said slide relatively to said frame, said cam surface being positioned on said first sidewall of said slide.

15. The pistol according to claim 14, wherein said cam surface is angularly oriented with respect to said first rail.

16. The pistol according to claim 8, wherein said axis is oriented perpendicularly to a line of motion of said slide relatively to said frame.

17. The pistol according to claim 8, further comprising a spring acting on said trigger bar for biasing said trigger bar away from said frame.

18. The pistol according to claim 17, wherein said spring comprises a leaf spring mounted on said trigger bar.

19. The pistol according to claim 8, wherein said portion of said trigger bar engageable with said sear comprises an end of said trigger bar.

20. A method of resetting a sear into a ready position during operation of a pistol, said method comprising:

moving a slide;

engaging a cam surface on said slide with a cam follower on a rotatable body and thereby rotating said rotatable body;

engaging a contact surface on said rotatable body with a trigger bar engaged with said sear and thereby moving said trigger bar relatively to said sear and out of engagement therewith;

moving said sear into said ready position upon disengagement with said trigger bar.

* * * * *